United States Patent [19]

Mellard

[11] 3,975,845

[45] Aug. 24, 1976

[54] ORNAMENTAL DISPLAY

[76] Inventor: George K. Mellard, 17360 - 232nd St., SW. Lot 34, Goulds, Fla. 33170

[22] Filed: Mar. 21, 1975

[21] Appl. No.: 560,622

[52] U.S. Cl. ..... 40/106.3; 46/92; 46/264; 119/5

[51] Int. Cl.[2] ..... A63H 13/20

[58] Field of Search ..... 40/106.3, 106.31, 106.45, 40/106.33, 106.35, 106.25, 126 R, 126 B, 139, 33; 119/5; 43/26.2; 46/92, 91, 245, 32; 272/31 R

[56] References Cited

UNITED STATES PATENTS

| | | | |
|---|---|---|---|
| 1,512,283 | 10/1924 | Fritsche | 46/245 X |
| 1,838,215 | 12/1931 | Clairmont | 119/5 |
| 2,691,845 | 10/1954 | Jepson | 40/106.3 |
| 2,874,513 | 2/1959 | Connell | 272/31 R X |
| 2,932,918 | 4/1960 | Pearson | 46/245 |
| 3,239,956 | 3/1966 | Canonica | 40/106.45 |
| 3,650,056 | 3/1972 | Walton | 40/106.25 |

*Primary Examiner*—John F. Pitrelli
*Attorney, Agent, or Firm*—Ashlan F. Harlan, Jr.

[57] ABSTRACT

An ornamental display which simulates a fishbowl with one or more imitation fish moving therein in circular paths, a dipping or bobbing motion being imparted to each of said fish at one or more points in said path by interaction of a wire projecting from said fish with a stationary cam wire.

6 Claims, 11 Drawing Figures

ORNAMENTAL DISPLAY

BACKGROUND OF THE INVENTION

The present invention relates to display devices and is particularly concerned with an ornamental device that simulates fish swimming in a fishbowl.

The attractiveness of a fishbowl with swimming fish is well known. Indeed, sometimes the effect of the constant motion of the colored fish is so soothing as to be somewhat hypnotic. However, the keeping of live fish on display is troublesome. Not only must the water in the bowl be replenished and, at times, changed, but the fish must also be fed from time to time. Also, on occasion a fish is attacked by disease and must then be promptly removed from the bowl. Further, there is often danger of the bowl being upset with consequent wetting of and damage to surrounding objects. For the above-mentioned and other reasons, many people would not consider keeping live fish.

SUMMARY OF THE INVENTION

It is an object of the present invention to provide an ornamental display device that closely simulates a fishbowl containing water in which one or more fish continually swim with varying motions, but which is free from the disadvantages of keeping live fish.

This object is attained by providing on a suitable base, a bowl containing a motor-driven, rotatable stage or platform on which one or more imitation fish are pivotally mounted for travel in circular paths. Means is provided whereby, as the stage rotates, a dipping or bobbing motion is imparted to each of the imitation fish at one or more points in the path thereof.

As hereinafter pointed out, a number of other contrivances are used to increase the apparent reality of the display device.

SHORT DESCRIPTION OF THE DRAWINGS

THE INVENTION

Figure 1:
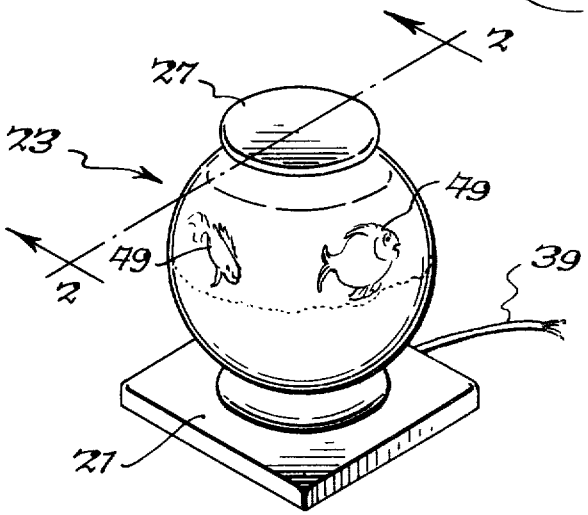
FIG. 1 is a perspective view of a display device according to the invention.

The ornamental display device of the present invention, as illustrated in FIG. 1 comprises a base 21 of any suitable shape and desired material, such as wood.

Inverted on the base 21, with its open end down, is a generally globular bowl 23. Suitable spring clips 25 attached in suitable manner to the base 21 removably secure the bowl on the base, preferably centered on the upper face of the latter. The closed end of the bowl is covered with a layer of paint or a plastic cap 27 which simulates a cover so that the bowl appears to be upright, rather than inverted.

Mounted on the base 21, within the bowl 23, is a small, geared, electric motor 31 having a vertical output shaft 33 coaxial with the vertical axis of the bowl 23. The electrical leads 35 to the motor 31 are joined by screw connectors 37 to a line cord 39 which passes through a horizontal bore 41 in the base 21 to a vertical bore 43 adjacent the motor 31. At its upper end, the shaft 33 is connected by suitable means to a circular stage or platform 47 for rotation of the latter.

The stage or platform 47 supports a plurality of movable imitation fish 49. Each of the imitation fish (hereinafter called merely "fish") is mounted on a wire or rod 51 that is secured in and projects upwardly from a ball 53. The balls 53 are rotatably supported, in holes or openings 55 provided in the platform 47, by pivot wires 57 (see FIGS. 3 and 5) that pass through the balls. The wires 57 are secured, generally horizontally, across the openings 55 in suitable manner, e.g. by bending the ends of the wires about rivets 58. Thus, the fish 49 can oscillate about the pivot wires 57.

Figure 5:
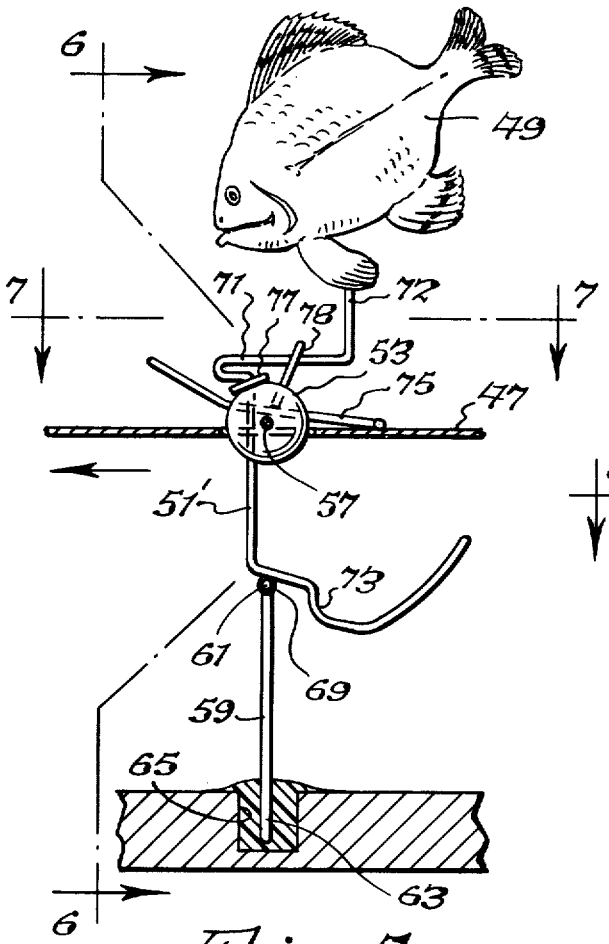
FIG. 5 is a fragmentary view showing a modification of the arrangement for producing the bobbing or dipping motion and stop means for preventing an excess of such motion.
Figure 6:
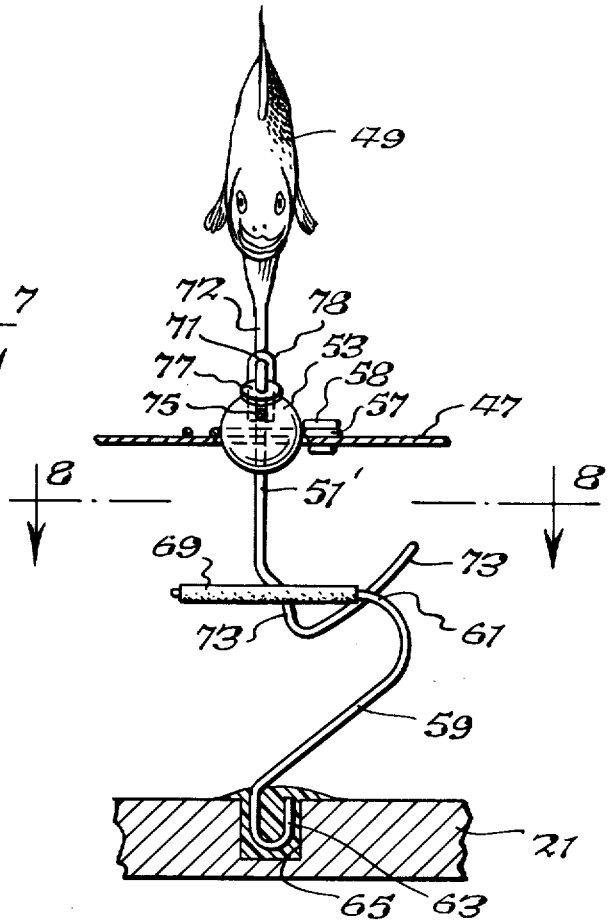
FIG. 6 is a fragmentary view, taken on line 6—6 of FIG. 5.
Figure 7:
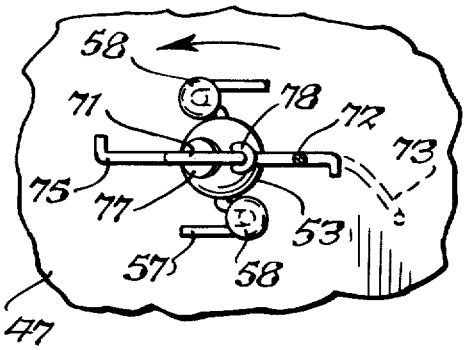
FIG. 7 is a detail view, taken on line 7—7 of FIG. 5.
Figure 8:
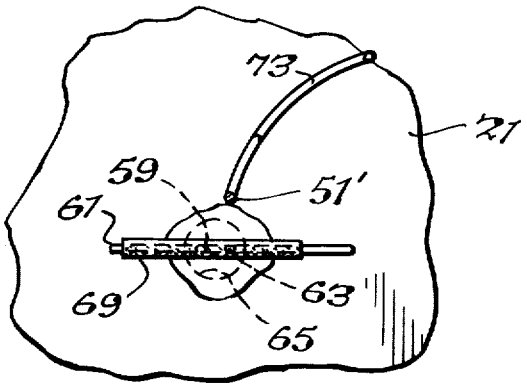
FIG. 8 is a detail view, taken on line 8—8 of FIG. 6.

Such oscillation is produced by use of a simple camming device operating on wires or rod 52 that are secured in and depend from the balls 53, preferably coaxially with the wires 51. The camming device is comprised of an upwardly extending wire or rod 59, the upper portion 61 of which is bent inwardly of the bowl 23 in substantially a horizontal position. The cam wire 59 is conveniently mounted on the base 21 (as shown in FIGS. 5 and 6) by bending over the lower end 63 of the wire and securing it with a suitable adhesive in a bore 65 in the base. The bent upper portion 61 of the wire or rod 59 is periodically and successively engaged, as the stage or platform 47 rotates, by the wires 52 which project downwardly from the balls 53 and are bent rearwardly and inwardly toward the vertical axis of the bowl 23 to form cam engaging portions 67. As the portion 67 of each wire 52 engages and rides over the camming portion 61 of the wire or rod 59, the fish attached to the upper end of the associated wire 51 will bob or duck forwardly and downwardly and will then, after some oscillation, return to its normal upright position. This action will take place successively and repeatedly with each of the fish 49 as the motor 31 turns the shaft 33 and the attached stage or platform 47. To reduce friction between the wires 52 and the cam wire 59, a sleeve 69 of suitable plastic, e.g. nylon or a vinyl resin, may be provided on the horizontal portion 61 of the cam wire.

Figure 2:
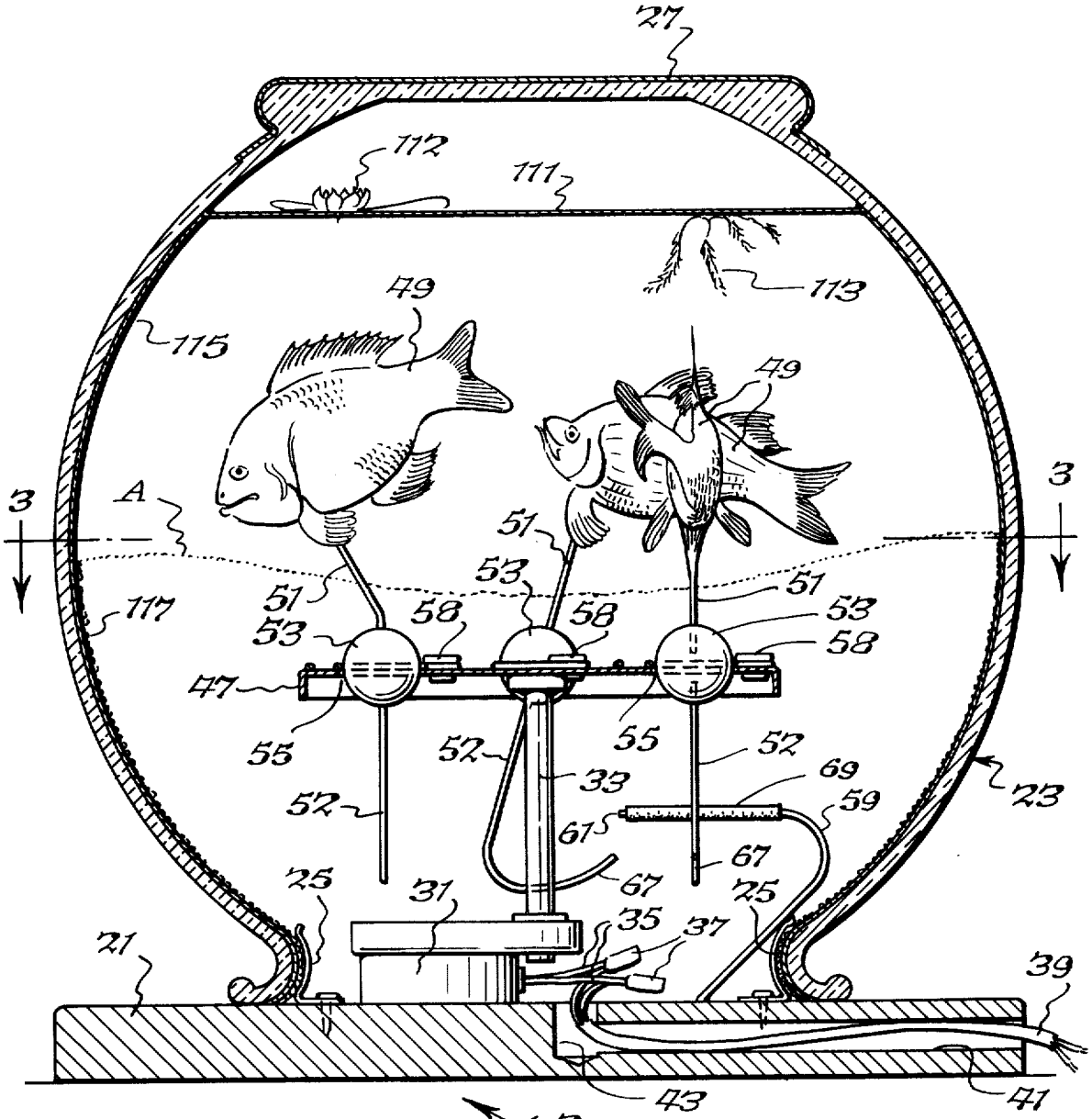
FIG. 2 is an enlarged vertical sectional view, on the line 2—2, through the device illustrated in FIG. 1 showing in elevation three imitation fish.
Figure 3:
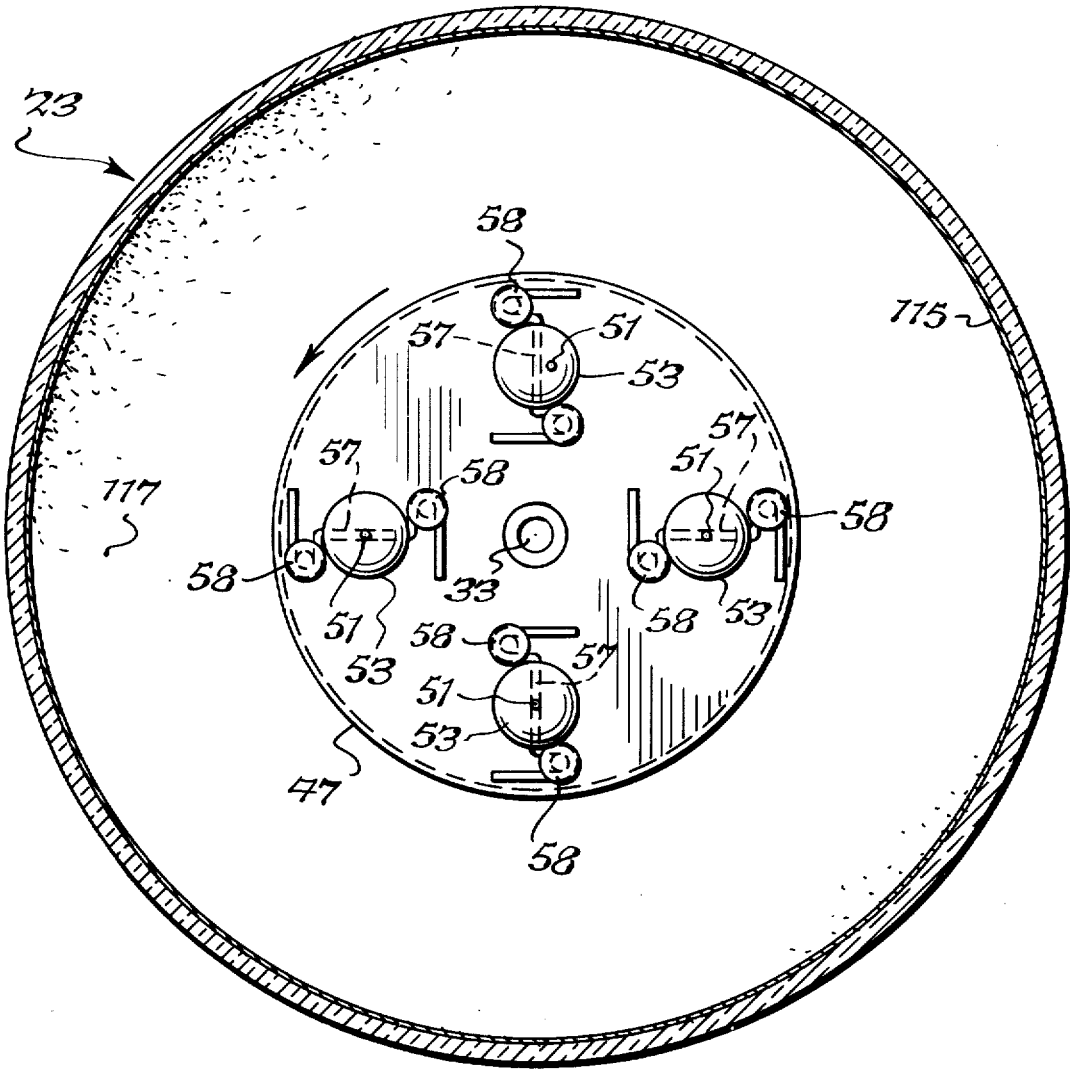
FIG. 3 is a substantially horizontal sectional view, taken on line 3—3 of FIG. 2.

FIGS. 5 and 6 illustrate certain modifications of the device shown in FIGS. 2 and 3. In such modified form of the invention each of the fish 49 is supported by a wire 51' and a pivoted ball 53. The wire 51' has a portion 72, that projects vertically upwardly from the long leg of a horizontally disposed J-shaped portion 71, to which the fish is attached. A vertically disposed portion of the wire 51' that projects from the short leg of the J-shaped portion 71 extends downwardly through the ball 53. The lower end 73 of the wire 51' is preferably provided with a compound bend for producing a gentle, irregular, bobbing motion of the fish 49 as the wire end 73 rides over the horizontal end 61 of the cam wire 59. Further, in such modification, a generally horizontal stop pin or bar 75 is provided. The pin 75 extends through the ball 53 above the pivot wire 57 and prevents excessive forward or backward tilting of the wire extension 72 and fish 49. Thus, the bobbing or dipping motion of the fish is restrained. As shown in FIG. 5, with the fish at rest the right end of the stop pin engages the stage or platform 47. When the bent lower end 73 of the fish-supporting wire 51' engages the cam wire 59, the ball 53 rotates and the upwardly bent left end of the pin 75 may contact the platform 47. A washer 77 is also provided where the wire 51' enters the ball and a wire loop anchor 78 projects from the ball 53 and guides or restrains the upper portion of supporting wire 51'.

Figure 9:
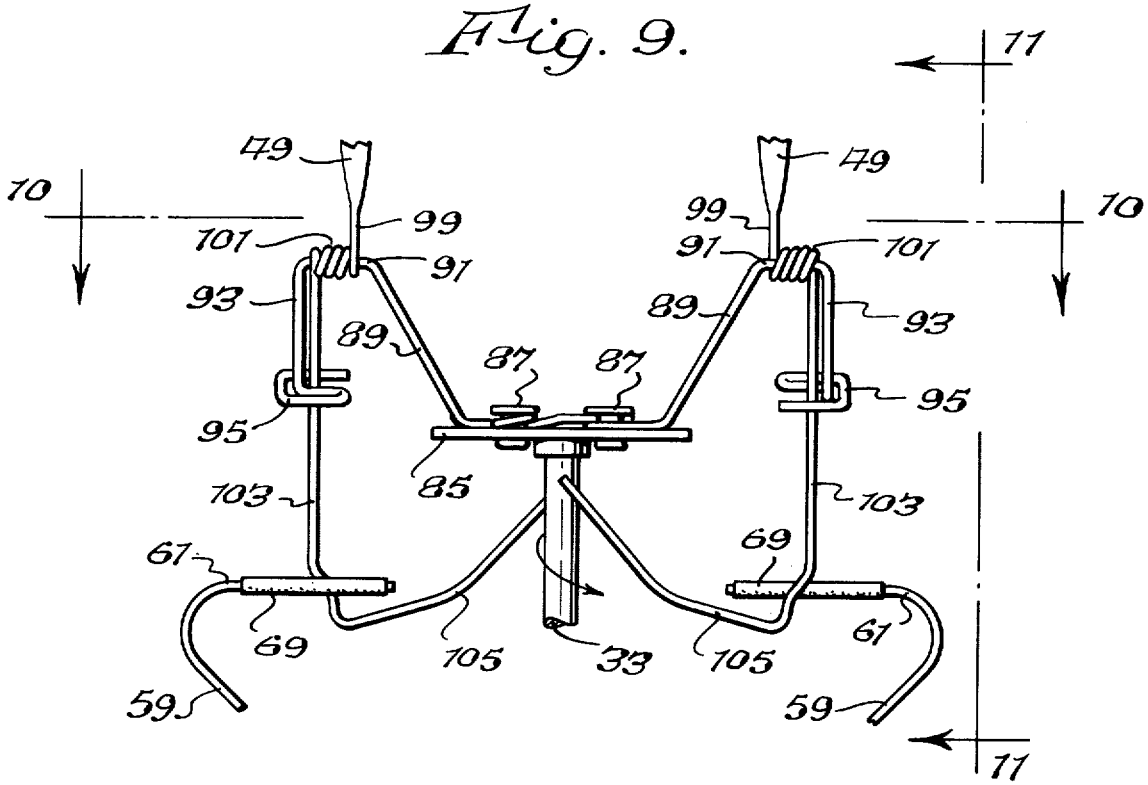
FIG. 9 is a fragmentary view illustrating another type of stage and supporting means for imitation fish according to the invention.
Figure 10:
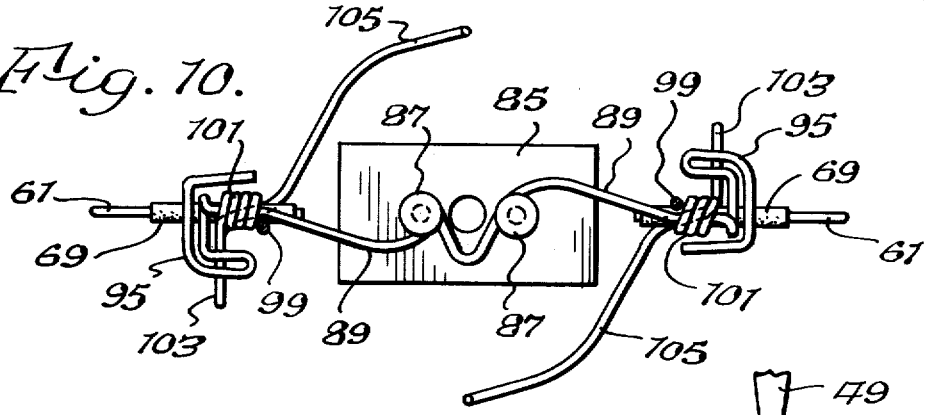
FIG. 10 is a detail view, in plan, taken on line 10—10 of FIG. 9.
Figure 11:
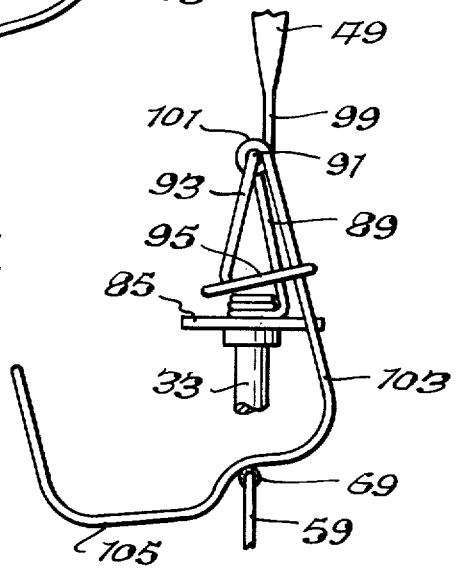
FIG. 11 is a detail view, in elevation, taken on line 11—11 of FIG. 9.

Additional modifications of the structure of an ornamental display according to the present invention are illustrated in FIGS. 9 – 11. In these figures, the output shaft 33 of the drive motor (not shown) is suitably connected to a small stage or platform 85 for rigid support of the latter. The stage 85 is provided with pivot wires 89 that may, as shown, be joined. It will be understood that any desired number of pivot wires may be carried by the stage or platform 85, to which they may be rigidly attached by any suitable means, e.g. by rivets 87 around which the wires 89 may be wound. The platform 85 may be of any desired shape and should be of adequate size to allow balancing of the load carried thereby.

Each of the pivot wires 89 preferably extends upwardly and outwardly from the stage 85 and has a horizontal portion 91, an outer depending portion 93, and a stop portion 95. The horizontal portion 91 serves as a pivot member for the imitation fish (partially shown at 49) and the depending supporting wire. The latter comprises a coil portion 101 that encircles the horizontal portion 91 of the pivot wire 89, an upwardly extending portion 99 that carries the fish 49, and a downwardly extending portion 103, the lower end 105 of which is bent, compoundly, inwardly and rearwardly for engagement with the cam wires 59. The latter are constructed and mounted on the base (not shown) as previously described.

In use, the modified form of apparatus illustrated in FIGS. 9 – 11 performs in substantially the same manner as the previously described apparatus. As the shaft 33 and stage or platform 85 revolve, the fish 49 follow circular paths around the axis of the shaft 33. As the lower ends 105 of the wires 103 engage and pass over the horizontal portions 61 of the cam wires 59, the fish 49 dip or bob and oscillate about the pivot portion 91 of the wires 89. Movement of the fish is restrained by the stop portions 95 of the wires 89. Each portion 95 comprises a U-shaped, open-ended loop produced by bending the end of the wire 89. The portions 103 of the fish-supporting wires extend downwardly through the U-shaped loops and the oscillatory movement thereof is thus limited.

As shown in FIGS. 9 and 10, two angularly spaced cam wires 59 are provided. This, of course, results in each of the fish dipping and/or bobbing at two points in its circular travel. It will be understood that the number of cam wires may vary as desired in any particular embodiment. It will also be understood that other desired camming means may be provided for engagement with the wires that depend from the fish to produce bobbing of the fish.

Preferably, a clear plastic disc or plate 111 is secured in the bowl 23 above the fish 49 to simulate a water surface. If desired, this effect may be enhanced by attaching to the disc 111 artificial aquatic life forms such as lily 112 and/or weed 113. Further to add realism, the interior of the bowl 23 may be sprayed with a clear lacquer 115 to give the effect of water inside between the plastic disc 81 and a level, designated A, between the fish and the platform 47. By applying sand 117 to a wet lacquer coating between the level A and the lower end of the bowl, the sand is made to stick to the interior bowl surface, thus making it appear from outside that the fish are swimming in water above a bed of sand. If desired, sand may also be coated on and adhesively held on the upper surface of the platform 47 and/or other objects within the bowl. Also, if desired, illumination can be provided in the bowl 23 by suitable lighting devices.

Figure 4:
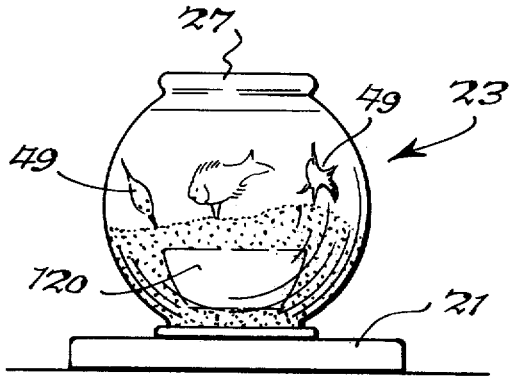
FIG. 4 is a reduced view, similar to FIG. 1, showing a modification of the bowl.

FIG. 1 illustrates how the ornamental display device of the invention appears to a viewer. FIG. 4 illustrates a modification in which a clear area 120 is provided in the interior coating on the bowl to allow viewers to see the mechanism inside.

It will be understood that many other modifications and changes may be made without departing from the spirit of the invention. For example, the base can be smaller and round so as to fit inside the open end of the bowl; the fish, instead of being three dimensional, may be only two dimensional and attached to the supporting wires by adhesive; the fish can be decorated with glitter, sequins or other material and, if desired, can have suitable legends thereon. It will further be understood that the size and number of fish employed may vary as desired, counter weights being added if necessary to balance the plate 47. It will further be understood that the present invention can be used to simulate the flight of birds, butterflies, and the like, and the movement of other life forms. Consequently, in the foregoing specification and the appended claims, use of the word "fish" is not intended to be restrictive, but to be merely representative of life forms in general.

The terms "upper", "lower", "top", "bottom", "right", "left", "above", "below", "vertical", and "horizontal", and similar terms of position and/or direction as used herein refer to the illustrations in the respective figures, but are used only for convenience in description and/or reference. Such terms should not be so construed as to imply a necessary positioning of the structure or portions thereof, or to limit the scope of this invention.

I claim:

1. An ornamental display device comprising: a bowl, said bowl being transparent, at least in part; a base for said bowl; at least one artificial fish in said bowl; rotatable means in said bowl supported by said base; supporting means for said fish, said supporting means including an upwardly extending wire pivotally carried by said rotatable means; camming means comprising a bent wire and mounted on said base and extending under said rotatable means; cam engaging means carried by said supporting means, and operatively connected to said fish, adapted to engage said camming means periodically upon rotation of said rotatable means whereby to impart an oscillating pivotal motion to said fish; and means for causing rotation of said rotatable means.

2. A display device as defined in claim 1 wherein said rotatable means comprises a platform rotating around a vertical axis.

3. A display device as defined in claim 2 wherein said cam engaging means comprises a downwardly extending wire having a bent lower end.

4. A display device as defined in claim 1 wherein said cam engaging means comprises a downwardly extending wire having a bent lower end.

5. A display device as defined in claim 4 wherein said cam engaging means has a sliding contact with said camming means.

6. A display as defined in claim 5 wherein said rotatable means comprises a platform rotating around a vertical axis.

* * * * *